US009556871B2

(12) United States Patent
Assaf

(10) Patent No.: US 9,556,871 B2
(45) Date of Patent: Jan. 31, 2017

(54) LIQUID RING COMPRESSOR

(71) Applicant: Agam Energy Systems Ltd., Hod Hasharon (IL)

(72) Inventor: Gad Assaf, Beer Sheva, IL (US)

(73) Assignee: Agam Energy Systems Ltd., Hod Hasharon (IL)

( * ) Notice: Subject to any disclaimer, the term of this patent is extended or adjusted under 35 U.S.C. 154(b) by 0 days.

(21) Appl. No.: 14/492,325

(22) Filed: Sep. 22, 2014

(65) Prior Publication Data

US 2015/0017027 A1 Jan. 15, 2015

Related U.S. Application Data

(63) Continuation-in-part of application No. 11/917,153, filed as application No. PCT/IL2006/000680 on Jun. 12, 2006, now Pat. No. 9,181,948.

(30) Foreign Application Priority Data

Jun. 15, 2005 (IL) ..... 169162

(51) Int. Cl.
*F04C 19/00* (2006.01)
*F04C 7/00* (2006.01)
(Continued)

(52) U.S. Cl.
CPC ..... *F04C 19/002* (2013.01); *F01C 17/02* (2013.01); *F01C 21/0809* (2013.01); *F04C 7/00* (2013.01);
(Continued)

(58) Field of Classification Search
CPC ..... F04C 7/00; F04C 19/002; F04C 19/004; F04C 19/008
(Continued)

(56) References Cited

U.S. PATENT DOCUMENTS 953,222 A * 3/1910 Nash ..... 417/68
1,463,646 A 7/1923 Chilowsky
(Continued)

FOREIGN PATENT DOCUMENTS

DE 37 18 551 A1 12/1988
DE 10 2006 04994 A1 3/2008
(Continued)

OTHER PUBLICATIONS

Office Action corresponding to co-pending European Patent Application No. 11 715 758.6-1608, dated Jun. 3, 2014 (6 pages).

*Primary Examiner* — Charles Freay
*Assistant Examiner* — Christopher Bobish
(74) *Attorney, Agent, or Firm* — Nixon Peabody LLP

(57) ABSTRACT

A liquid-ring, rotating-casing compressor comprises a shaft carrying an impeller having a core and a plurality of radially extending vanes rotatably coupled to the shaft for rotation around a first axis, and a tubular casing mounted for rotation relative to the impeller around a second axis that is parallel to and offset from the first axis. The casing and impeller define a compression zone wherein edges of the vanes rotate in increasing proximity to an inner surface of the casing and an expansion zone wherein edges of the vanes rotate in increasing spaced-apart relationship along an inner surface of the casing. An inlet port communicates with the expansion zone, an outlet port communicates with the compression zone, and a drive imparts rotating motion to the casing. The eccentricity ecr of the casing relative to the impeller is between about (1−c)/4 and (1−c)/9, preferably less than half (1−c)/3.

4 Claims, 4 Drawing Sheets

(51) Int. Cl.

| | |
|---|---|
| ***F01C 17/02*** | (2006.01) |
| ***F01C 21/08*** | (2006.01) |
| *F04C 29/04* | (2006.01) |

(52) U.S. Cl.
CPC ..... *F04C 19/004* (2013.01); *F04C 19/008* (2013.01); *F04C 29/042* (2013.01)

(58) Field of Classification Search
USPC ..... 417/68
See application file for complete search history.

(56) References Cited

U.S. PATENT DOCUMENTS

| | | | | |
|---|---|---|---|---|
| 2,201,575 | A * | 5/1940 | Corneil et al. | 417/67 |
| 2,937,499 | A | 5/1960 | Klemt | |
| 4,112,688 | A | 9/1978 | Shaw | |
| 4,747,752 | A | 5/1988 | Somarakis | |
| 4,981,413 | A | 1/1991 | Elonen et al. | |
| 5,100,300 | A * | 3/1992 | Haavik | 417/68 |
| 5,122,035 | A | 6/1992 | Juhola | |
| 5,636,523 | A | 6/1997 | Assaf | |
| 5,722,255 | A | 3/1998 | Brasz | |
| 6,412,291 | B1 | 7/2002 | Erickson | |
| 2009/0290993 | A1 | 11/2009 | Assaf | |

FOREIGN PATENT DOCUMENTS

| | | |
|---|---|---|
| FR | 865434 | 5/1941 |
| FR | 999464 | 1/1952 |
| WO | WO 96/22467 A1 | 7/1996 |
| WO | WO 2006/134590 | 12/2006 |

* cited by examiner

| A | B | C | D | E | F | G | H | I | J | K | L | M | N | O | P | Q | R |
|---|---|---|---|---|---|---|---|---|---|---|---|---|---|---|---|---|---|
| RPM | Power | Epsilon | vc | ro | rm | pm | Delr | l-Ep-Dr | | wi | wo | ds | r | 24 | | q turn | |
| 2900 | 0.67 | 0.0833 | 36.54 | 0.5 | 0.55 | 0.97 | 0.08 | 0.8367 | | 332.17 | 304.5 | 0 | 3.17 | NEG= | 7 | 0.0307066 | |
| R | DP* | BM | Brm | Uim | DP | rd | ri | Rdisc | | mi, kW | Beta | air fric. | DTI C | 17 | No Blad | | |
| 0.12 | 6.68 | 0.11 | 0.076 | 33.35 | 7.94 | 0.760 | 0.9167 | 0.843 | | 0.12946 | 26 | 0.02427 | 15 | | | | |
| Frdisc | ri* | vc(Rdi) | CD | Pdisc | ql | qa | Qa kg/s | Eff | | 0.02571 | S W . | DT ad | Ad Eff | SW* | EF | q* | |
| 6.0E-02 | 0.000 | 30.82 | 3 | 2.06 | 0.11 | 0.0634 | 0.09408 | | | Pad | 8.16 | 116.311 | 83.45% | 8.21 | | 0.053082 | |
| Teta | Env. | r | Peq*100 | MT(kW) | Vt(m/s) | Mj(kW) | pj(bar) | Work | Tad | | Vo | Vteta | qti | qo | Mber | Mimp | Denv |
| 0 | 1.08 | 0.859 | -12.80 | -2.96 | 36.87 | 0.00 | 0.97 | 0.00 | 280 | 0.97 | 36.87 | 0.00 | 0.0000 | 0.1092 | 0.000 | 0.000 | 0.000 |
| 15 | 1.08 | 0.8566 | -13.41 | 0.29 | 36.94 | 0.00 | 0.97 | 0.00 | 280 | 0.97 | 36.94 | 0.00 | 0.0000 | 0.1092 | 0.000 | 0.000 | 0.000 |
| 30 | 1.07 | 0.85 | -10.70 | 1.44 | 37.23 | 0.00 | 0.97 | 0.00 | 280 | 0.97 | 37.23 | 0.00 | 0.0000 | 0.1092 | 0.000 | 0.000 | 0.000 |
| 45 | 1.06 | 0.839 | -11.63 | 2.69 | 37.60 | 0.00 | 0.97 | 0.00 | 280 | 0.97 | 37.60 | 0.00 | 0.0000 | 0.1092 | 0.000 | 0.004 | 0.000 |
| 60 | 1.04 | 0.811 | -11.82 | 0.95 | 37.17 | 1.19 | 1.09 | 1.14 | 292 | 1.13 | 37.50 | 32.84 | 0.0077 | 0.1092 | 0.000 | 0.027 | 0.000 |
| 75 | 1.02 | 0.773 | -10.57 | -3.50 | 36.23 | 1.97 | 1.32 | 1.92 | 314 | 1.44 | 37.08 | 32.08 | 0.0186 | 0.0905 | 0.000 | 0.065 | 0.000 |
| 85 | 1.01 | 0.713 | -0.83 | -11.44 | 32.32 | 7.67 | 2.38 | 6.71 | 340 | 3.08 | 32.99 | 30.89 | 0.0348 | 0.0743 | -0.005 | 0.090 | 0.004 |
| 105 | 0.98 | 0.664 | 1.19 | -16.49 | 31.75 | 0.00 | 2.38 | 0.00 | 340 | 3.08 | 33.14 | 29.91 | 0.0471 | 0.0621 | -0.005 | 0.090 | 0.004 |
| 120 | 0.96 | 0.628 | 0.03 | -3.75 | 31.23 | 0.00 | 2.38 | 0.00 | 340 | 3.08 | 33.35 | 29.19 | 0.0556 | 0.0536 | -0.004 | 0.023 | 0.004 |
| 135 | 0.94 | 0.596 | -1.53 | -3.40 | 30.74 | 0.00 | 2.38 | 0.00 | 340 | 3.08 | 33.70 | 28.55 | 0.0627 | 0.0463 | -0.003 | 0.023 | 0.003 |
| 150 | 0.93 | 0.572 | 1.31 | -2.58 | 30.46 | 0.00 | 2.38 | 0.00 | 340 | 3.08 | 34.36 | 28.08 | 0.0678 | 0.0414 | -0.002 | 0.023 | 0.002 |
| 165 | 0.92 | 0.556 | 1.40 | -1.70 | 30.23 | 0.00 | 2.38 | 0.00 | 340 | 3.08 | 34.83 | 27.76 | 0.0711 | 0.0381 | -0.001 | 0.020 | 0.001 |
| 180 | 0.92 | 0.55 | 0.00 | -1.16 | 30.11 | 0.00 | 2.38 | 0.00 | 340 | 3.08 | 34.95 | 27.64 | 0.0723 | 0.0369 | -0.001 | 0.008 | 0.001 |
| 195 | 0.92 | 0.6015 | -13.04 | 14.97 | 35.20 | -4.28 | 1.38 | -2.93 | 245 | 0.97 | 43.64 | 28.66 | 0.0615 | 0.0477 | 0.019 | 0.152 | 0.023 |
| 210 | 0.93 | 0.6175 | -14.63 | 19.04 | 35.38 | 0.00 | 0.97 | 0.00 | 245 | 0.97 | 42.63 | 28.98 | 0.0579 | 0.0512 | 0.014 | 0.231 | 0.016 |
| 225 | 0.94 | 0.643 | -12.34 | 2.29 | 35.76 | 0.00 | 0.97 | 0.00 | 245 | 0.97 | 41.48 | 28.49 | 0.0521 | 0.0571 | 0.009 | 0.128 | 0.011 |
| 240 | 0.96 | 0.674 | -14.63 | 2.84 | 36.09 | 0.00 | 0.97 | 0.00 | 245 | 0.97 | 40.24 | 30.11 | 0.0447 | 0.0645 | 0.005 | 0.061 | 0.005 |
| 255 | 0.98 | 0.7094 | -13.54 | 3.04 | 36.52 | 0.00 | 0.97 | 0.00 | 245 | 0.97 | 39.30 | 30.81 | 0.0358 | 0.0734 | 0.003 | 0.026 | 0.003 |
| 270 | 1.00 | 0.7454 | -16.03 | 3.03 | 36.85 | 0.00 | 0.97 | 0.00 | 245 | 0.97 | 38.53 | 31.53 | 0.0263 | 0.0829 | 0.002 | 0.012 | 0.002 |
| 285 | 1.02 | 0.781 | -14.93 | 2.79 | 37.21 | 0.00 | 0.97 | 0.00 | 245 | 0.97 | 38.09 | 32.24 | 0.0164 | 0.0928 | 0.001 | 0.005 | 0.001 |
| 300 | 1.04 | 0.814 | -10.46 | 2.96 | 37.58 | 0.00 | 0.97 | 0.00 | 245 | 0.97 | 37.89 | 32.90 | 0.0068 | 0.1024 | 0.001 | 0.003 | 0.001 |
| 315 | 1.06 | 0.839 | -13.83 | 1.80 | 37.65 | 0.00 | 0.97 | 0.00 | 268 | 0.97 | 37.65 | 0.00 | 0.0000 | 0.1092 | 0.000 | 0.001 | 0.000 |
| 330 | 1.07 | 0.852 | -9.41 | 0.09 | 37.60 | 0.00 | 0.97 | 0.00 | 268 | 0.97 | 37.60 | 0.00 | 0.0000 | 0.1092 | 0.000 | 0.001 | 0.000 |
| 345 | 1.08 | 0.86 | -8.40 | -0.49 | 37.53 | 0.00 | 0.97 | 0.00 | 268 | 0.97 | 37.53 | 0.00 | 0.0000 | 0.1092 | 0.000 | 0.001 | 0.000 |
| Average | | 0.68935 | -202.19 | 11.23 | 67.06 | 6.55 | 8.45929 | 6.59 | | 6.85 | 35.73 | 21.32 | | | 0.036 | 0.918 | 0.082 |

| | A | B | C | D | E | F | G |
|---|---|---|---|---|---|---|---|
| 1 | Compressor Efficiency | | | DP=λρU²L/(20) | λ=0.316/Re^1/4 | | Re |
| 2 | 13.07 | 01-Aug | | Uen m/s | | RPM Mot | 101381.1321 |
| 3 | 4.08cm | L=2915mm | λ= | 0.0177316 | 0:00 | Rpm Comp | Ni(40)=1.7 Ni(20)=1.486E-5, |
| 4 | Measure mm | | | | | | |
| 5 | | 5-Nov-09 | 5-Nov-09 | 6-Nov-09 | 6-Nov-09 | 6-Nov-09 | Average |
| 6 | SP Volume m^3/kg of air in the exit pipe | 0.98 | 0.98 | 0.98 | 0.98 | 0.98 | |
| 7 | water gage mm | 157 | 162 | 148 | 149 | 148 | |
| 8 | hr start | 08:35 | 18:20 | 07:50 | 08:00 | 18:20 | |
| 9 | hr end | 08:46 | 18:28 | 08:00 | 08:15 | 18:28 | |
| 10 | RPM | 3013 | 3010 | 3021 | 3018 | 3010 | |
| 11 | Average air velocity in the exit pipe m/s | 49.36 | 50.14 | 47.92 | 48.08 | 47.92 | |
| 12 | Air flow at the pipe liter/s | 64.509 | 65.529 | 62.633 | 62.844 | 62.633 | 63.630 |
| 13 | Air flwo at the inlet pipe liter/s | 66.30 | 67.36 | 64.37 | 64.59 | 64.37 | |
| 14 | Adiabatic temperature elevation C | 109.81 | 109.81 | 111.75 | 112.14 | 112.14 | |
| 15 | Ad. work for dry air kW | 7.26 | 7.38 | 7.18 | 7.23 | 7.20 | |
| 17 | Exit vapor mixing ratio g/kg | 41 | 41 | 43 | 41 | 41 | |
| 18 | Adiabtic vapor work kW | 0.50 | 0.51 | 0.51 | 0.49 | 0.49 | |
| 19 | Adiabatic work for air+vapor kW | 7.76 | 7.89 | 7.69 | 7.72 | 7.70 | 7.752 |
| 20 | Water flow liter/hr | 30 | 60 | 30 | 30 | 30 | |
| 21 | Air flow gr/s. | 65.83 | 66.87 | 63.91 | 64.13 | 63.91 | 6.49E+01 |
| 22 | Electric power kW | 11.05 | 11.25 | 11.25 | 11.25 | 11.25 | |
| 23 | Mech. Work :Engine eff. 90% belt eff. 5% Kw | 9.3925 | 8.5625 | 9.5625 | 9.5625 | 9.5625 | 9.53E+00 |
| 24 | Pi, Pressure at the inlet pascal | 9.73E+04 | 9.73E+04 | 9.73E+04 | 9.73E+04 | 9.73E+04 | |
| 25 | Pe, Pressure at exit pascal | 2.95E+05 | 2.95E+05 | 3.00E+05 | 3.01E+05 | 3.01E+05 | |
| 26 | Logn (Pe/Pi) | 1.11 | 1.11 | 1.13 | 1.13 | 1.13 | |
| 27 | | | | | | | |
| 28 | Tis, where ISO thermal eff. +Adiabatic eff. | | | | | | |
| 29 | C | 74.6 | 74.6 | 75.5 | 75.7 | 75.7 | |
| 30 | Adiabatic efficency | 83% | 82% | 80% | 81% | 80% | 81.36% |
| 31 | Pressure ration (pe/Pi) | 3.03 | 3.03 | 3.08 | 3.09 | 3.09 | |
| 32 | TI | 21.50 | 21.50 | 21.50 | 21.50 | 21.50 | |
| 33 | Temperature elevation DT where Ti+DT=Tis C | 53.12 | 53.12 | 53.98 | 54.16 | 54.16 | |
| 34 | Water in C | 32.00 | 36.00 | 24.00 | 28.00 | 34.00 | |
| 35 | Water out C | 52.00 | 51.00 | 52.00 | 51.00 | 52.00 | |
| 36 | Rotating water ring temperature C | 37.00 | 37.00 | 36.00 | 36.11 | 37.00. | |
| 37 | Temperature elevation of inlet water C | 5.00 | 1.00 | 12.00 | 8.00 | 3.00 | |
| 38 | Wet bulb temperature at inlet air C | 17.50 | 17.50 | 16.50 | 16.50 | 16.50 | |
| 39 | Wet bulb temperature of exit air C | 41.50 | 41.00 | 41.20 | 41.30 | 41.70 | |
| 40 | Air inlet temperature C | 21.50 | 21.50 | 20.50 | 20.50 | 20.50 | |
| 41 | Exit air temperature C | 62.00 | 58.00 | 58.00 | 58.00 | 58.00 | |
| 42 | Inlet air enthalpy kJ/kg | 48.00 | 48.00 | 46.00 | 46.00 | 45.00 | |
| 43 | Exit air enthalpy kJ/kg | 180.00 | 175.00 | 177.00 | 178.00 | 180.00 | |
| 44 | Enthaly elevation at the compressor kJ/kg | 132.00 | 127.00 | 131.00 | 132.00 | 135.00 | |
| 45 | Air heating kW | 8.69 | 8.49 | 8.37 | 8.46 | 8.63 | |
| 46 | Exit water heating kW | 0.52 | 0.98 | 0.56 | 0.52 | 0.52 | |
| 47 | Air exit cooling kJ/kg | 7.04 | 12.94 | 7.74 | 7.23 | 7.25 | |
| 48 | Air enthalpy defor exit kJ/kg | 187.04 | 187.94 | 184.74 | 185.23 | 187.25 | |
| 49 | Waterheat kW | 0.70 | 1.05 | 0.98 | 0.80 | 0.63 | |
| 50 | Heat lost kW | 0.21 | 0.21 | 0.21 | 0.21 | 0.22 | |
| 51 | ShaftW-compressor work | -0.20 | -0.18 | 0.01 | 0.09 | 0.09 | -0.039 |
| 52 | Comp diab kW | 0.38 | 0.28 | 0.62 | 0.49 | 0.32 | |

FIG. 6

LIQUID RING COMPRESSOR

CROSS-REFERENCE TO RELATED APPLICATIONS

This application is a continuation-in-part of and claims priority to U.S. patent application Ser. No. 11/917,153, filed Dec. 11, 2007, which is a U.S. national phase of and claims priority to International Application No. PCT/IL2006/000680, filed Jun. 12, 2006, which claims the benefit of priority to Israeli Application No. 169162, filed Jun. 15, 2005, each of which is incorporated by reference in its entirety.

FIELD OF THE INVENTION

The present invention relates to Liquid Ring Compressors (LRC's) and more specifically to LRC's with rotating casings.

BACKGROUND OF THE INVENTION

U.S. Pat. No. 5,636,523 discloses an LRC and expander having a rotating jacket, the teachings of which are incorporated herein by reference.

This known LRC, however, has several disadvantages: while the jacket is free to rotate by the liquid ring which is driven by the rotor, the velocity of the rotating casing lags behind the rotor's tips, rendering the flow unstable namely, causing inertial instability, especially when the angular momentum becomes smaller with large radiuses (the angular momentum of a liquid element located at a radius r is defined as the product u·r, where u is the tangential velocity). As the liquid velocity near the jacket follows the jacket's velocity, when the jacket's velocity lags behind the rotor's velocity, the friction, which is formed between the liquid and the jacket and the liquids between the liquid ring and the rotor vanes, will cause instability in the compressor.

Furthermore, in the prior art LRC, the lateral disc-shaped walls of the compressor are stationary. Thus, the liquid ring which rotates around the wet stationary walls, will also generate friction, detracting from the overall efficiency of the compressor.

SUMMARY

In accordance with one embodiment, a liquid-ring, rotating-casing compressor comprises a shaft carrying an impeller having a core and a plurality of radially extending vanes rotatably coupled to the shaft for rotation around a first axis; a tubular casing having an inner surface and an outer surface and mounted for rotation relative to the impeller around a second axis that is parallel to and offset from the first axis, the casing defining with the impeller a compression zone wherein edges of the vanes rotate in increasing proximity to an inner surface of the casing and an expansion zone wherein edges of the vanes rotate in increasing spaced-apart relationship along an inner surface of the casing; an inlet port communicating with the expansion zone; an outlet port communicating with the compression zone, and a drive for imparting rotating motion to the casing, wherein the eccentricity ecr of the casing relative to the impeller is between about (1−c)/4 and (1−c)/9, wherein ecr=e/R, e is the distance between the first and second axes, and c is the ratio of the radius C of the shaft to the radius R of the casing. The eccentricity ecr is preferably less than half (1−c)/3.

In accordance with another embodiment, a liquid-ring, rotating-casing compressor comprises a shaft carrying an impeller having a core and a plurality of radially extending vanes rotatably coupled to the shaft for rotation around a first axis; a tubular casing having an inner surface and an outer surface and mounted for rotation relative to the impeller around a second axis that is parallel to and offset from the first axis, the casing defining with the impeller a compression zone wherein edges of the vanes rotate in increasing proximity to an inner surface of the casing and an expansion zone wherein edges of the vanes rotate in increasing spaced-apart relationship along an inner surface of the casing; an inlet port communicating with the expansion zone; an outlet port communicating with the compression zone, and a drive for imparting rotating motion to the casing, wherein the eccentricity ecr of the casing relative to the impeller is selected to produce an adiabatic efficiency of at least 0.7, wherein ecr=e/R, e is the distance between the first and second axes, and c is the ratio of the radius C of the shaft to the radius R of the casing. The adiabatic efficiency is preferably greater than 0.8.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is an isometric, partly exposed view, of the LRRCC, according to the present invention;

FIG. 2 is an isometric view of an impeller for the LRRCC, according to the present invention;

FIG. 3 is a cross-sectional view of the LRRCC along line III-III of FIG. 1, according to the present invention, and FIG. 4 is a cross-sectional view along line IV-IV of FIG. 3.

FIG. 5 is a table of the results of a hydrodynamic analysis of a liquid-ring, rotating-casing compressor embodying the present invention.

FIG. 6 is a table of the results of a test of a prototype of a liquid-ring, rotating-casing compressor embodying the present invention.

DETAILED DESCRIPTION OF PREFERRED EMBODIMENTS

Figure 1:
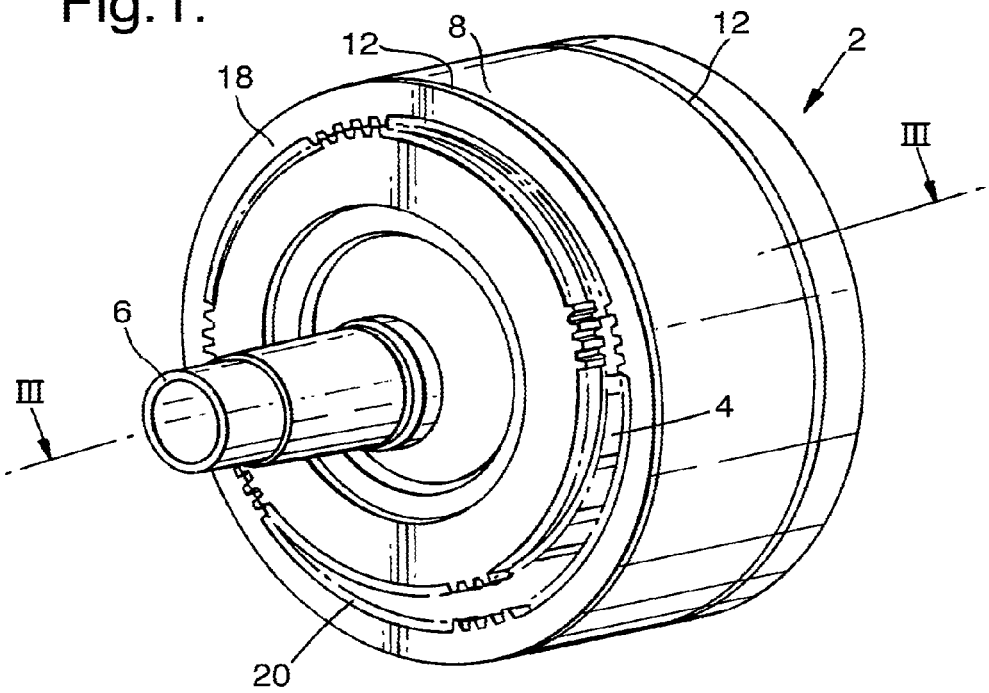
Figure 2:
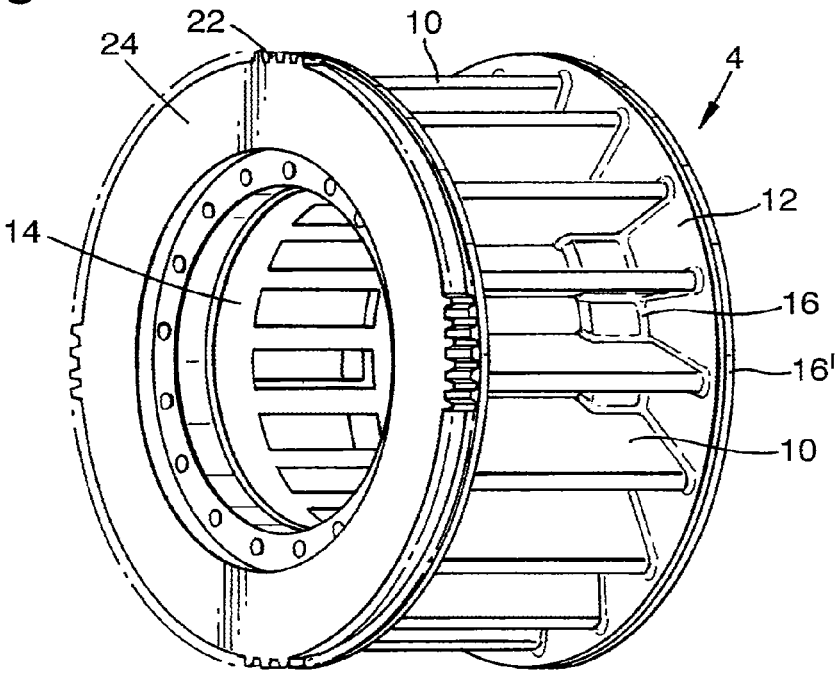

An isometric, partly exposed view of an LRRCC 2 is shown in FIG. 1. The compressor 2 has a general cylindrical shape and is composed of three major parts: an inner impeller 4 mounted on a shaft 6, and a casing 8 configured as a curved surface of a cylinder. The shaft 6 is stationary and advantageously hollow, and the impeller 4 is rotatably coupled thereon, as seen in detail in FIG. 3. The impeller 4 is shown in FIG. 2 and includes a plurality of radially extending vanes 10 mounted about a core 14, and ring-shaped side walls 12 having concentric inner edges 16 and outer edges 16'. Advantageously, as seen in the FIG. 2, the vanes 10 terminate radially inwardly of the outer edges 16' of the impeller side walls 12. Further seen in FIG. 1 is the casing 8 eccentrically rotatably coupled with the impeller 4 and extending across the outer edges of the vanes 10 between the side walls 12 of the impeller. Optionally, the casing 8 is mechanically coupled to the impeller 4. For this purpose the casing 8 is fitted with lateral rings 18 having internal teeth 20, configured to mesh with outer teeth 22 of the impeller. The teeth 22 are made on rings 24 attached to the outer sides of the side walls 12 of the impeller 4. Hence, when teeth 20 and 22 are meshed, the impeller 4 will rotate about the shaft 6 at a constant velocity with respect to the velocity of the casing 8. Preferably, the velocity of the casing 8 should be greater than 70% of the velocity of the impeller 4.

The eccentricity ecr of the casing 8 with respect to the impeller 4 is given by the formula:

$$ecr<(1-c)/3,$$

wherein ecr=e/R, where e is the distance between the impeller and casing axes and c is the ratio of the radius C of the shaft 6 to the radius R of the casing 8.

The eccentricity ecr is preferably between about (1−c)/4 and about (1−c)/9, and the adiabatic efficiency is preferably at least 0.7, most preferably greater than 0.8.

Figure 3:
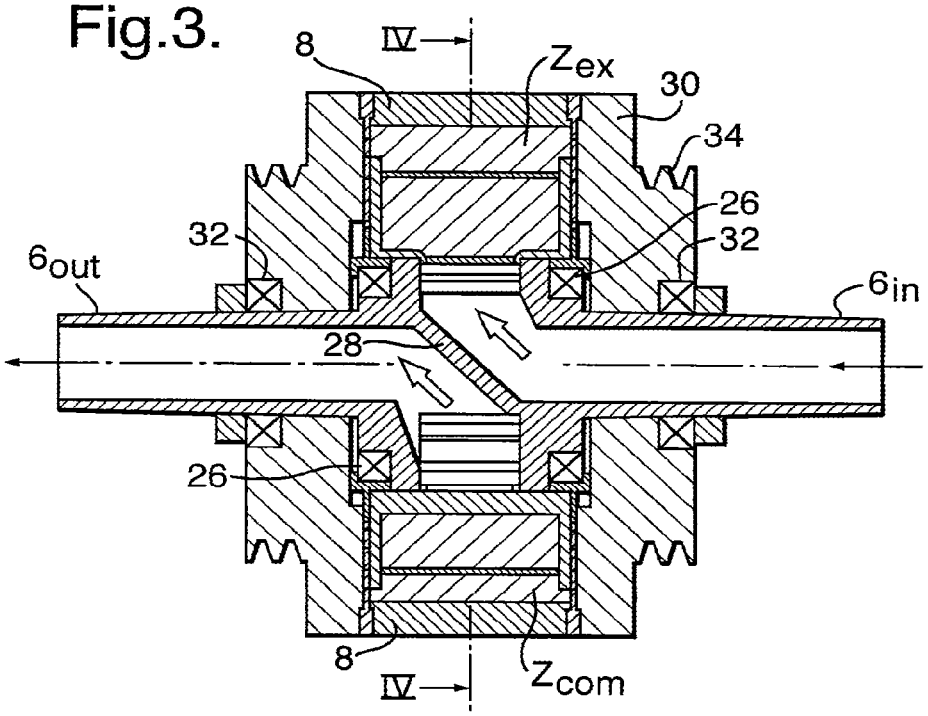
Figure 4:
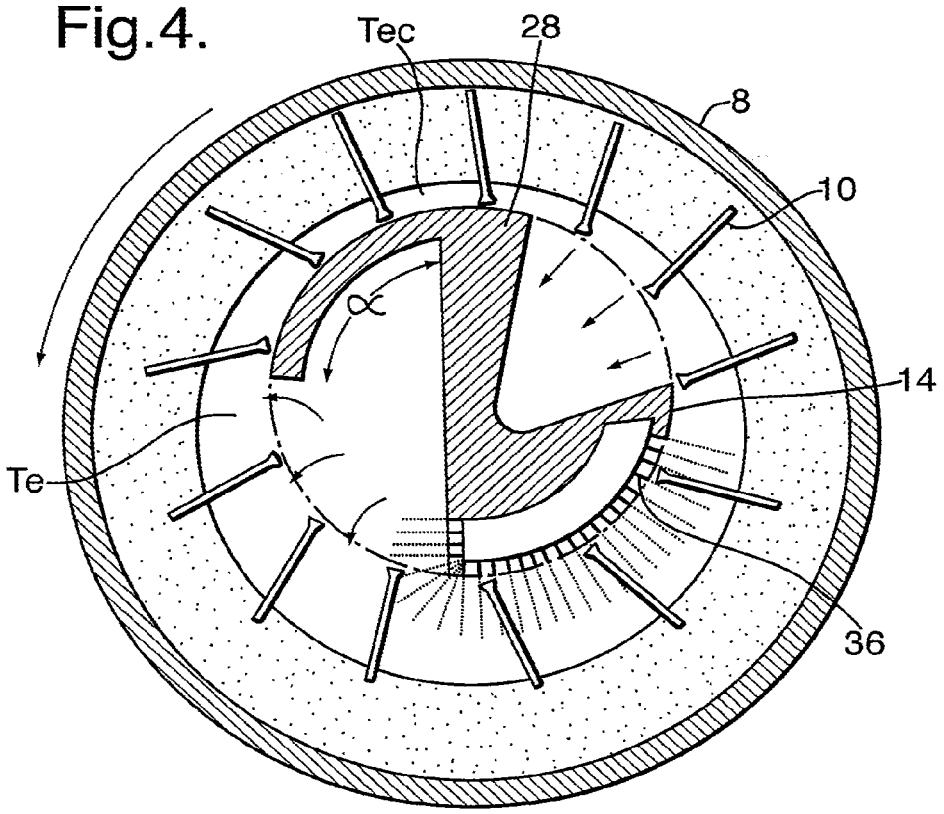

Referring to FIGS. 3 and 4, it can be seen that once the shaft mounted impeller and casing are assembled, there are formed inside the casing 8 two distinct zones defined by the inner surface of the casing 8 and the impeller 4: a compression zone $Z_{com}$ where the edges of the vanes 10 are disposed and rotate in increasing proximity to the inner surface of the casing 8 and an expansion zone $Z_{ex}$ where the edges of the vanes 10 are disposed and rotate in increasing spaced-apart relationship along an inner surface of the casing 8. Also seen in FIG. 3 are bearings 26 coupling the impeller 4 on the shaft 6, the hollow shaft inlet portion $\mathbf{6}_{in}$ and an outlet portion $\mathbf{6}_{out}$ separated from the inlet portion $\mathbf{6}_{in}$ by a partition 28.

The casing 8 is driven by an outside drive means such as a motor (not shown), coupled to the casing by any suitable means such as belts, gears, or the like. In FIG. 3 there is shown a casing, drive coupling means 30 mounted on the shaft 6 via bearings 32. The drive coupling means 30 may be provided on any lateral side of the casing 8, on both sides (as shown), or alternatively, the casing 8 may be driven by means provided on its outer surface. The ribs 34 are provided for guiding driving belts (not shown) leading to a motor.

The radial liquid flow near the border between the compression zone $Z_{com}$ and expansion zone $Z_{ex}$ is associated with high liquid velocity variations between the vanes 10 and the casing 8. This tangential velocity variation is dissipative. To reduce the dissipative velocity, in the present invention the ends of the vanes 10 are shorter as compared with the impeller's side walls 12. In this way, the distance between the ends of the vanes 10 and the casing 8 increases, the dissipative velocity is reduced and the efficiency increases.

In the compression zone $Z_{com}$ shaft work is converted to heat. Cold fluid can be introduced into the compression zone $Z_{com}$, thus heat will be extracted from the compression zone by the cold liquid. In this way, the compressed gas will be colder, further increasing the compressor's efficiency, as less shaft work is required to compress cold gas than hot gas.

In one embodiment, the fluid (usually cold water) should be atomized and sprayed directly into the compression zone $Z_{com}$. To be effective, the droplet average diameter by volume should advantageously be smaller than 200 microns. In order to extract most of the generated heat and keep the air temperature at low levels, the liquid mass flow ml (kg/s) should be comparable to the air mass flow, say ml>ma/3.

In FIG. 4, there are illustrated spray nozzles 36 formed in the core 14 about which the vanes 10 are mounted. As can be seen, the spray nozzles 36 may be formed on the partition 28, so as to direct atomized fluid in two directions.

In the compression zone $Z_{com}$ near the border or interface between the two zones, liquid waves are developed. The waves are associated with leakage of compressed air to the expanding zone $Z_{ex}$, which is dissipative in nature. The wave's amplitude and with it, the leakage, increases with distance between two neighboring vanes. To reduce the leakage, the vane numbers should be larger than 10. Furthermore, it is required that the leakage air will expand at the expanding zone $Z_{ex}$. For this reason, the vanes 10 should be close to the central shaft 6, so that the interval between the vanes and the duct will be small and the angle $\alpha$ between the narrow point Tec and the opening to the low pressure inlet Te exceeds ½ radian.

Figure 5:
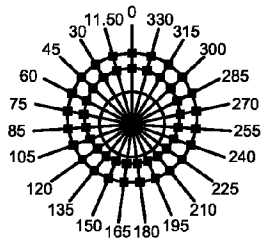

FIG. 5 is a table containing the results of a hydrodynamic analysis of a compressor of the type illustrated in FIGS. 1-4 and having an eccentricity ecr of 0.0833, a casing radius of 120 mm, an impeller shaft radius of 60 mm and an impeller length of 100 mm, with the maximum distance between the inside surface of the casing and the impeller located at the high-pressure exit zone. The critical eccentricity ecr was ⅙=0.166, so the critical difference between the impeller and the casing radius was 120 mm/6=20 mm. The actual difference used was 10 mm. The hydrodynamic model predicted the location of the liquid interface, which is the inner circle in the drawing in FIG. 5. The outer circle is the location of the inside wall of the casing. The space coordinates are non-dimensional ("ND") in FIG. 5, and to obtain the physical coordinates the ND coordinates are multiplied by the casing radius (120 mm). The results in FIG. 5 show compression of 63 grams/second from 0.97 to 3.07 bar using 8.3 kW, with an adiabatic efficiency of 83%. The liquid ring thickness is 44 mm, as compared with a thickness of only 27 mm at the low pressure inlet.

FIG. 6 is a table containing the results produced by an actual proof-of-concept prototype compressor having the same configuration as the model used in the hydrodynamic analysis that produced the results in FIG. 6. The results shown in FIG. 6 are close to the hydrodynamic analysis results shown in FIG. 5, with a flow rate of 63 liters/second, a pressure ratio of about 3, and an adiabatic efficiency of 81%.

To operate as a compressor, the compartment between a pair of adjacent vanes of the impeller must be closed at both ends, because only then can gas in that compartment be compressed. At least two such closed compartments are required for a compressor, and at least four such compartments are preferred.

As depicted in FIG. 4, each of the impeller vanes preferably remains in operative engagement with the annular ring of liquid throughout each complete revolution of the impeller relative to the casing, so there is never any clearance between any of the vanes and the liquid ring.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A liquid-ring, rotating-casing compressor comprising:

a hollow shaft carrying an impeller having a core and a plurality of radially extending vanes rotatably coupled to said shaft for rotation around a first axis, a tubular casing having an inner surface extending around a liquid ring inside said casing and an outer surface and mounted for rotation relative to said impeller around a second axis that is parallel to and offset from said first axis, said casing defining with said impeller a compression zone wherein edges of said vanes rotate in increasing proximity to an inner surface of the casing and wherein compartments between adjacent vanes are completely closed, and an expansion zone wherein edges of said vanes rotate in increasing spaced-apart relationship along an inner surface of the casing;

an inlet port communicating with said expansion zone, an outlet port communicating with said compression zone, and a drive for imparting rotating motion to said casing, wherein the eccentricity ecr of said casing relative to said impeller is between (1−c)/4 and (1−c)/9, wherein ecr=e/R, e is the distance between said first and second axes, and c is the ratio of the radius C of the shaft to the radius R of the casing, and wherein said vanes are in operative engagement with an annular ring of liquid inside said casing throughout each complete revolution of said impeller relative to said casing.

2. The liquid-ring, rotating-casing compressor of claim 1 in which said eccentricity ecr is less than half (1−c)/3.

3. A liquid-ring, rotating-casing compressor comprising:

a hollow shaft carrying an impeller having a core and a plurality of radially extending vanes rotatably coupled to said shaft for rotation around a first axis, said shaft having a radius C, a tubular casing having a radius R, an inner surface extending around a liquid ring inside said casing and an outer surface and is mounted for rotation relative to said impeller around a second axis that is parallel to and offset from said first axis, said casing defining with said impeller a compression zone wherein edges of said vanes rotate in increasing proximity to an inner surface of the casing and wherein compartments between adjacent vanes are completely closed, and an expansion zone wherein edges of said vanes rotate in increasing spaced-apart relationship along an inner surface of the casing;

an inlet port communicating with said expansion zone, an outlet port communicating with said compression zone, and a drive for imparting rotating motion to said casing, wherein the eccentricity ecr of said casing relative to said impeller produces an adiabatic efficiency of between 0.7 and 0.83, wherein ecr=e/R, e is the distance between said first and second axes, and c is a ratio of the radius C of the shaft to the radius R of the casing, and wherein said vanes are in operative engagement with an annular ring of liquid inside said casing throughout each complete revolution of said impeller relative to said casing.

4. The liquid-ring, rotating-casing compressor of claim 3 wherein the eccentricity ecr of said casing relative to said impeller is selected to produce an adiabatic efficiency of at least 0.8.

* * * * *